US007663588B2

(12) United States Patent
Jang et al.

(10) Patent No.: US 7,663,588 B2
(45) Date of Patent: Feb. 16, 2010

(54) CIRCUIT AND METHOD FOR DRIVING FLAT DISPLAY DEVICE

(75) Inventors: Chul Sang Jang, Anyang-Si (KR); Jin Chul Choi, Gunpo-Si (KR)

(73) Assignee: LG Display Co., Ltd., Seoul (KR)

( * ) Notice: Subject to any disclaimer, the term of this patent is extended or adjusted under 35 U.S.C. 154(b) by 602 days.

(21) Appl. No.: 11/476,795

(22) Filed: Jun. 29, 2006

(65) Prior Publication Data

US 2007/0052642 A1 Mar. 8, 2007

(30) Foreign Application Priority Data

Sep. 6, 2005 (KR) ..... 10-2005-0082681

(51) Int. Cl.
*G09G 3/36* (2006.01)

(52) U.S. Cl. ..... 345/89; 345/98; 345/210; 345/690

(58) Field of Classification Search ..... 345/89, 345/98, 204, 210, 211, 212, 213, 690; 341/144
See application file for complete search history.

(56) References Cited

U.S. PATENT DOCUMENTS

| | | | | |
|---|---|---|---|---|
| 6,323,848 | B1 * | 11/2001 | Abe | 345/204 |
| 6,570,560 | B2 * | 5/2003 | Hashimoto | 345/211 |
| 2002/0033788 | A1 * | 3/2002 | Kato | 345/89 |
| 2003/0107432 | A1 * | 6/2003 | Huynh | 330/9 |
| 2005/0219097 | A1 * | 10/2005 | Atriss et al. | 341/144 |

* cited by examiner

*Primary Examiner*—Amare Mengistu
*Assistant Examiner*—Dmitriy Bolotin
(74) *Attorney, Agent, or Firm*—Birch, Stewart, Kolasch & Birch, LLP

(57) ABSTRACT

A circuit for driving a liquid crystal display device, as embodied, includes: a gray level voltage generator for generating a plurality of gray level voltages; and an intermediate gray level voltage generator for receiving a first gray level voltage and a second gray level voltage among the plurality of gray level voltages and for selectively outputting one of the first gray level voltage and a third gray level voltage through a plurality of capacitors, a value of the third gray level voltage being between the first and second gray level voltage and set by the plurality of capacitors, the intermediate gray level voltage generator including: an operational amplifier for pre-charging the plurality of capacitors using a current outputted from the operational amplifier and for selectively outputting one of the first gray level voltage and the third gray level voltage.

20 Claims, 7 Drawing Sheets

CIRCUIT AND METHOD FOR DRIVING FLAT DISPLAY DEVICE

This Nonprovisional Application claims priority under 35 U.S.C. §119(a) on Patent Application No. 10-2005-082681 filed in Korea on Sep. 6, 2005, the entire contents of which are hereby incorporated by reference.

BACKGROUND OF THE INVENTION

1. Field of the Invention

The present invention relates to an LCD device, and more particularly, to a circuit and method for driving an LCD device, which is capable of reducing power consumption of the LCD device.

2. Discussion of the Related Art

Generally, a liquid crystal display (LCD) panel includes two plates facing each other, and an LC layer with dielectric anisotropy characteristic between the two plates.

An LCD device including an LCD panel is operated such that, in a state where a voltage is applied to the LC layer, as intensity of electric fields formed by the voltage is controlled to adjust transmittance of light passing through the LC layer, desired images can be displayed thereon. The LCD device is a typical example of flat panel display (FPD) which can be easily carried. Most of LCD devices adopt a TFT-LCD panel which is implemented with thin film transistors (TFT) as a switching element, which is hereinafter referred to as a TFT-LCD device.

The TFT-LCD panel includes a plurality of gate lines for transmitting scan signals thereto, and a plurality of data lines for transmitting image data thereto. The data lines are formed by orthogonally crossing with the gate liens to define a plurality of pixels enclosed thereby. Namely, pixels are formed in a matrix type. Each pixel is connected to a gate line and a data line through a TFT.

In order to apply image signal to each pixel of the LCD device, a scan signal is sequentially applied to the gate lines such that the TFTs connected to the gate lines can be sequentially turned on, and, at the same time, an image signal (i.e., a gray level voltage), which will be applied to a row of pixels corresponding to the gate line, is applied to each data line. The image signal applied to the data line is applied to each pixel through the turned-on TFTs. Here, the gate ON signal is sequentially applied to all gate lines such that the image signal can be applied to all rows of pixels, for one frame period. Therefore, one frame of image is displayed on the LCD panel.

The gray level voltage applied to the data line of the LCD device is a voltage applied to the source of the TFT to generate gray levels. The gray levels of a color TFT-LCD device are determines by the bit number of Red-, Green- and Blue-data which are outputted from a graphic controller. For example, when Red-data of 6 bits are inputted, 64 ($2^6$) gray levels are formed such that a red can be expressed by 64 gray levels.

In order to express 64 gray levels, 64 gray level voltages are needed. For example, the voltage range between 0~10V (in case of high voltage drive) is equally divided into 64 steps, and then the voltages of the 64 steps are provided to the data driver. However, when the data driver has generates 8-divided voltages, it can be operated only if 9 gray level voltages are inputted to the data driver from the outside. Therefore, 9 gray level voltages are required such that the range of 0~10V can be divided into 8 steps. The above-described method for generating gray level voltages uses a voltage divider using a plurality of resistors.

The voltages divided by each resistor (hereinafter referred to as 'gray level voltage') serves to express the gray levels which are provided to the data lines according to the selection of the data signals. On the other hand, the resistor array (voltage divider) has disadvantages in that the greater the number of gray levels the greater the number of resistors is required. In order to resolve such a problem, a hybrid driving circuit using resistors and capacitors has been developed.

The related art hybrid driving circuit includes: a gray level voltage generator for generating a plurality of gray level voltages corresponding to the data of a part of bits among the data of N bits (N is a positive integer) for displaying images; a decoder unit for selecting and outputting two gray level voltages (hereinafter referred to as first and second gray level voltages) among the plurality of gray level voltages according to the data of a part of bits; a switching signal generator for combining data of the remaining bits among the data of N bits with control signals outputted from the outside and for generating a plurality of switching signals based on the combination result; and an intermediate gray level voltage generator for receiving the first and second gray level voltages from the decoder unit, for generating a third gray level voltage, whose value is between values of the first and second gray level voltages, and for selectively outputting the first or third gray level voltage according to the switching signals.

The intermediate gray level voltage generator receives the first and second gray level voltages from the decoder unit. The intermediate gray level voltage generator reads out a logic value of the least significant bit of the N bits data and outputs the first or third gray level voltage based on the readout result. Namely, when the logic value of the least significant bit is '0,' the intermediate gray level voltage generator outputs the first gray level voltage. On the other hand, when the logic value is '1,' the intermediate gray level voltage generator outputs the third gray level voltage.

The gray level voltage generator generates, for example, 32 gray levels of the total gray levels (for example, 64 gray levels). Also, the intermediate gray level voltage generator receives two adjacent gray level voltages and generates a third gray level voltage between the two adjacent gray level voltages.

More specifically, the intermediate gray level voltage generator will be described in detail below, referring to FIG. 1. FIG. 1 illustrates a circuit of an intermediate gray level voltage generator in a related art hybrid-type circuit for driving an LCD device. As shown in FIG. 1, the intermediate gray level voltage generator 103 includes an operational amplifier AMP, first and second capacitors CAP1 and CAP2, and $1^{st}$-$5^{th}$ switches SW1-SW5.

One end of the $1^{st}$ switch SW1 is connected to a first input lead 201 to which a first gray level voltage Vrl is provided. One end of the $2^{nd}$ switch SW2 is connected to a second input lead 202 to which a second gray level voltage Vrh is provided. Each of the other end of the $1^{st}$ and $2^{nd}$ switches SW1 and SW2 is connected to a first node n1. The first capacitor CAP1 is located between the first node 1 and the inverting lead (−) of the operational amplifier AMP. The $3^{rd}$ and $4^{th}$ switches SW3 and SW4 are serially located between the first node n1 and the output lead 203 of the operational amplifier AMP. The second capacitor CAP2 and the $5^{th}$ switch SW5 are serially located between a second node n2, which is between the $3^{rd}$ and $4^{th}$ switches SW3 and SW4, and the output lead 203 of the operational amplifier AMP. The inverting lead (−) of the operational amplifier AMP is connected to a third node n3 between the second capacitor CAP2 and the $5^{th}$ switch SW5. The non-inverting lead (+) of the operational amplifier AMP is connected to a third input lead 204 to which a reference voltage Vref is provided.

Here, the $1^{st}$-$5^{th}$ switches SW1-SW5 are turned on or turned off according to the switching signals of the switching signal generator (not shown). In reference, the switching signal generator is not always necessary. Namely, the intermediate gray level voltage generator can be controlled by other units providing the switch signal not by the switching signal generator. The intermediate gray level voltage generator 103 selectively turns on or off the $1^{st}$-$5^{th}$ switches SW1-SW5 according to the switching signals, such that one of the first gray level voltage Vrl and the third gray level voltage can be outputted to the output lead 203 of the operational amplifier AMP. Here, the magnitude of the third gray level voltage is determined by capacitances of the first and second capacitors CAP1 and CAP2.

As described above, the related art hybrid circuit for driving an LCD device reduces the number of resistors R as some of gray level voltages among the total gray level voltages are generated through the resistors of the gray level voltage generator and the remaining gray level voltages are generated by the capacitors CAP1 and CAP2 included in the intermediate gray level voltage generator 103. However, the related art circuit has disadvantages in that it must be configured such that the gray level voltage generator must provide a relatively high driving current to charge the capacitors CAP1 and CAP2, and the operational amplifier does not involve in charging the capacitors CAP1 and CAP2. Therefore, the power consumption of the gray level voltage generator is increased.

SUMMARY OF THE INVENTION

Accordingly, the present invention is directed to a circuit and method for driving an LCD device, that substantially obviate one or more problems due to limitations and disadvantages of the related art.

An object of the present invention is to provide a circuit and method for driving an LCD device, which are capable of reducing power consumption of a gray level voltage generator in an LCD device as capacitors are charged based on the high current driving capability of an operational amplifier.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a circuit for driving a liquid crystal display device includes: a gray level voltage generator for generating a plurality of gray level voltages; and an intermediate gray level voltage generator for receiving a first gray level voltage and a second gray level voltage among the plurality of gray level voltages and for selectively outputting one of the first gray level voltage and a third gray level voltage through a plurality of capacitors, a value of the third gray level voltage being between the first and second gray level voltage and set by the plurality of capacitors, the intermediate gray level voltage generator including: an operational amplifier for pre-charging the plurality of capacitors using a current outputted from the operational amplifier and for selectively outputting one of the first gray level voltage and the third gray level voltage.

In accordance with another aspect of the present invention, a method for driving a liquid crystal display device for displaying an image, includes: generating a plurality of gray level voltages; selecting a first gray level voltage and a second gray level voltage from the plurality of gray level voltages; pre-charging a plurality of capacitors using a current outputted from an operational amplifier; and selectively outputting one of the first gray level voltage and a third gray level voltage by the plurality of capacitors and the operational amplifier, a value of the third gray level voltage being between the first and second gray level voltage and set by the plurality of capacitors.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE ILLUSTRATED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1:
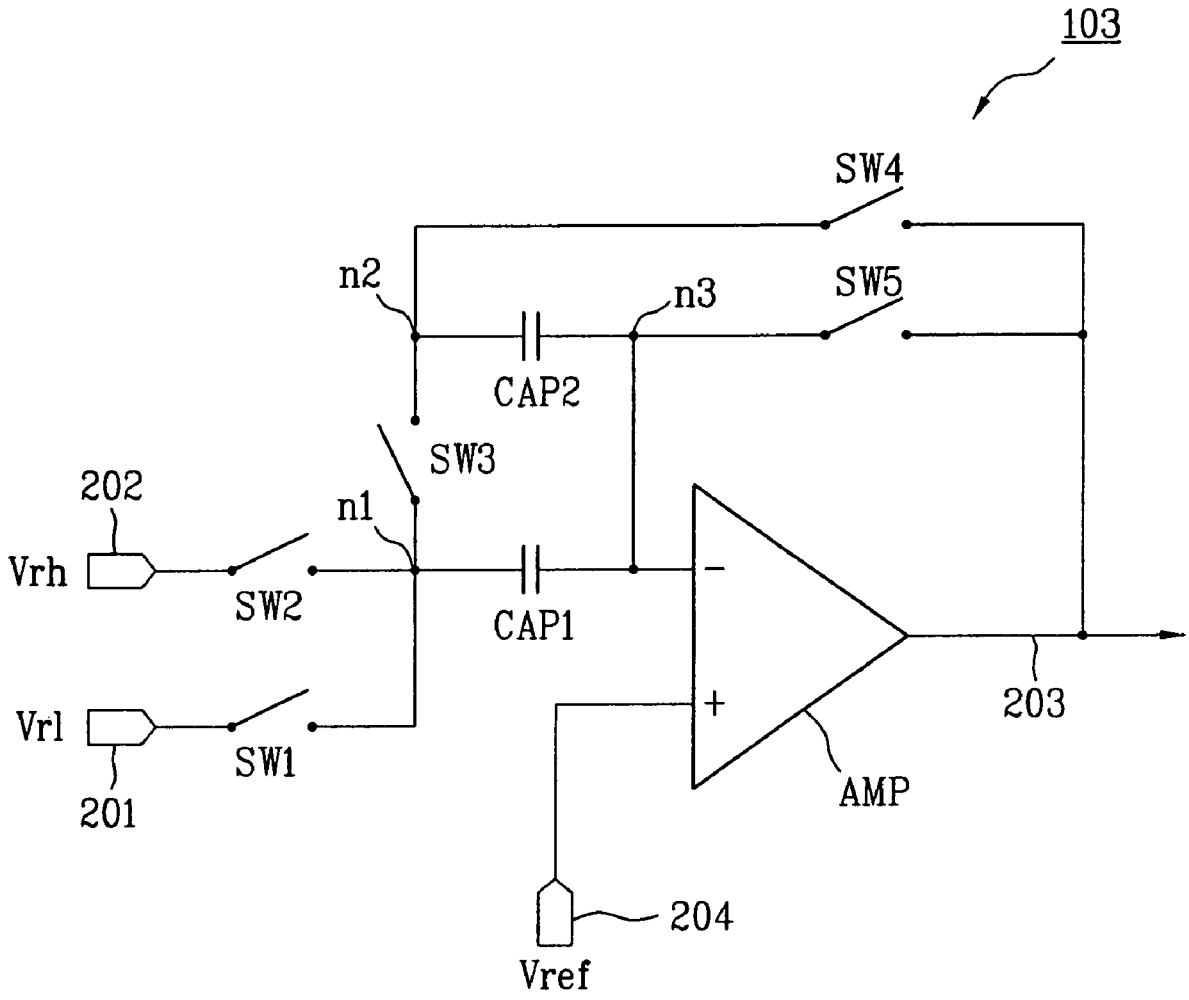
FIG. 1 Related Art
FIG. 1 illustrates a circuit of an intermediate gray level voltage generator in a related art hybrid-type circuit for driving an LCD device.
Figure 2:
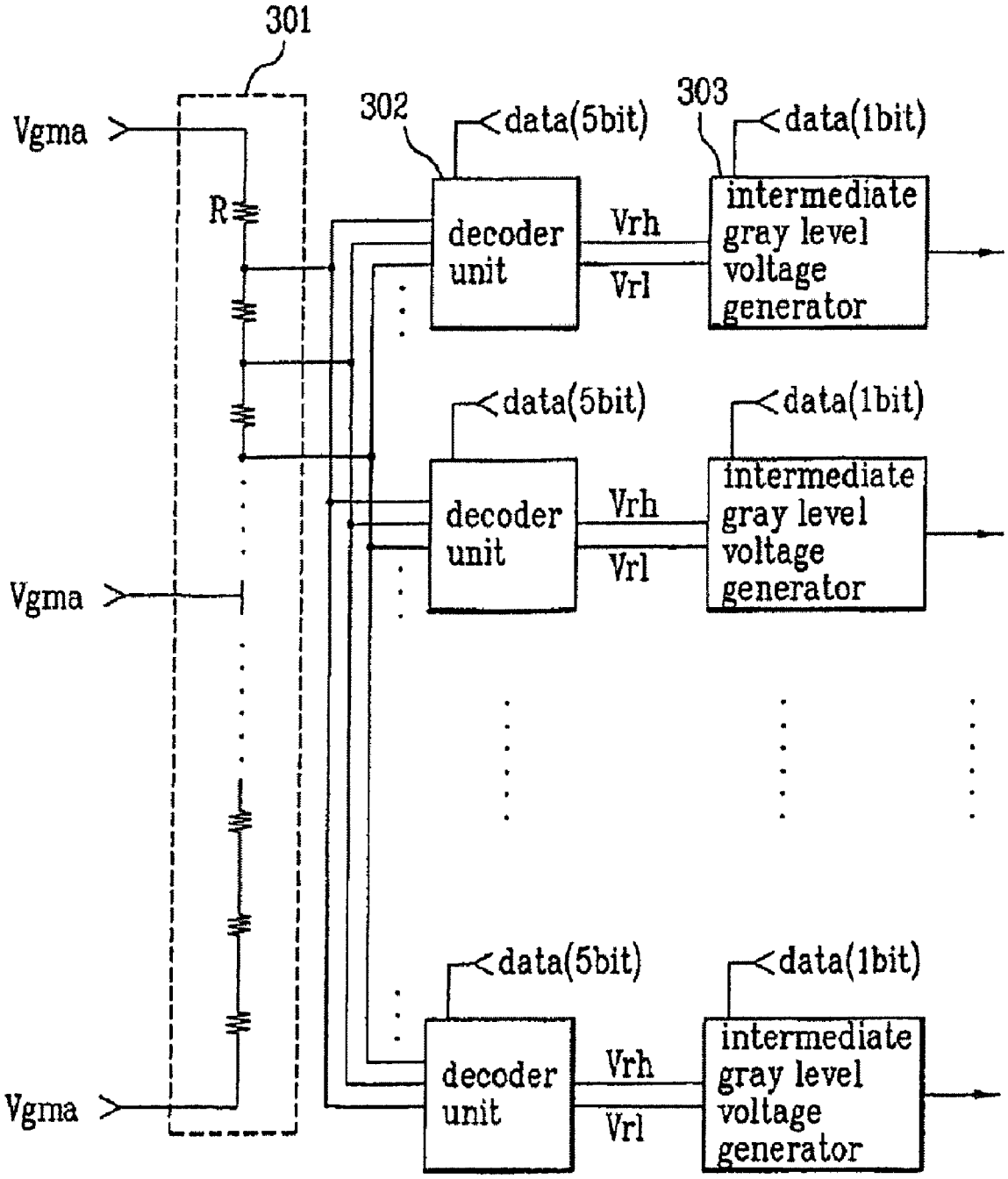
FIG. 2 Related Art
FIG. 2 illustrates a circuit for driving an LCD device according to an embodiment of the present invention.

FIG. 2 illustrates a circuit for driving an LCD device according to an embodiment of the present invention. As shown in FIG. 2, the driving circuit of an LCD device includes: a gray level voltage generator 301 for generating a plurality of gray level voltages corresponding to the data of a part of bits among data of N bits (N is a positive integer) for displaying images; a decoder unit 302 for selecting two (hereinafter referred to as a first gray level voltage Vrl and a second gray level voltage Vrh) among the plurality of gray level voltages, according to the data of the part of bits; a switching signal generator, not shown in the drawings, for combining the data of the remaining bits among the data of N bits with control signals inputted from the outside, and for generating a plurality of switching signals based on the combination result, thereby switching a plurality of switches in an intermediate gray level voltage generator 303; and an intermediate gray level voltage generator 303 for receiving the first and second gray level voltages Vrl and Vrh from the decoder unit 302, for generating a third gray level voltage, which is between the first and second gray level voltages, through at least one of capacitors CAP1 and CAP2, an operational amplifier AMP, and a plurality of switches which are operated by the switching signals, for selectively outputting one of the first gray level voltage Vrl and the third gray level voltage according to the switching signals of the switching signal generator to provide the selected gray level voltage to a data line of an LCD panel; and for pre-charging the capacitors CAP1 and CAP2 using a current outputted from the operational amplifier AMP which buffers into the first and third gray level voltages.

Here, the data includes digital video signals for displaying images. When N is 6 as illustrated in this embodiment, or when the data is digital data of 6 bits, the total gray levels can be 64 ($2^6$). Here, the gray level voltage generator 301 generates gray levels corresponding to most significant bits (5 bits in the embodiment) among the 6 data bits, namely 32 ($2^5$) gray level voltages in the illustrated embodiment. More specifically, since the gray level voltage generator 301 includes a plurality of resistors R, it generates the gray level voltages as a plurality of reference gray level voltages Vgma divided by the resistors R.

The decoder unit 302 serves to select the first gray level voltage Vrl corresponding to one of the data of 5 bits among the gray level voltages, and the second gray level voltage Vrh whose gray level differs from that of the first gray level voltage by one level of total 32 gray levels, and outputs the selected gray level voltage thereto. The decoder unit 302 includes a plurality of transistors. As each transistors receives the data of 5 bits to be selectively turned on and off, the decoder unit 302 outputs the gray level voltages, which are different from each other, according to a logic value of each bit in the 5-bit data. For example, a circuit for driving a LCD device includes 32 decoder units (D1~D32). Each decoder unit is controlled by one data among the data of 5 bits to select the Vrh and Vrl. And, each decoder unit has two transistors, which output the adjacent two Vgmas among 32 Vgmas from the gray level voltage generator 301 according to the one data. At this time, the adjacent two Vgmas outputted from decoder unit become Vrh and Vrl, respectively.

The intermediate gray level voltage generator 303 receives the first and second gray level voltages Vrl and Vrh from the decoder unit 302. The intermediate gray level voltage generator 303 reads out a logic value of the least significant bit of the N bits data, and then outputs one of the first gray level voltage Vrl and the third gray level voltage which is between the first gray level voltage Vrl and the second gray level voltage Vrh. Namely, when the logic value of the least significant bit is '0,' the intermediate gray level voltage generator 303 outputs the first gray level voltage Vrl. On the other hand, when the logic value of the least significant bit is '1,' the intermediate gray level voltage generator 303 outputs the third gray level voltage.

The gray level voltage generator 301 generates 32 gray levels among the total gray levels (64). The intermediate gray level voltage generator 303 receives the two adjacent gray level voltages, and then generates an intermediate gray level voltage, i.e., the third gray level voltage.

Figure 3:
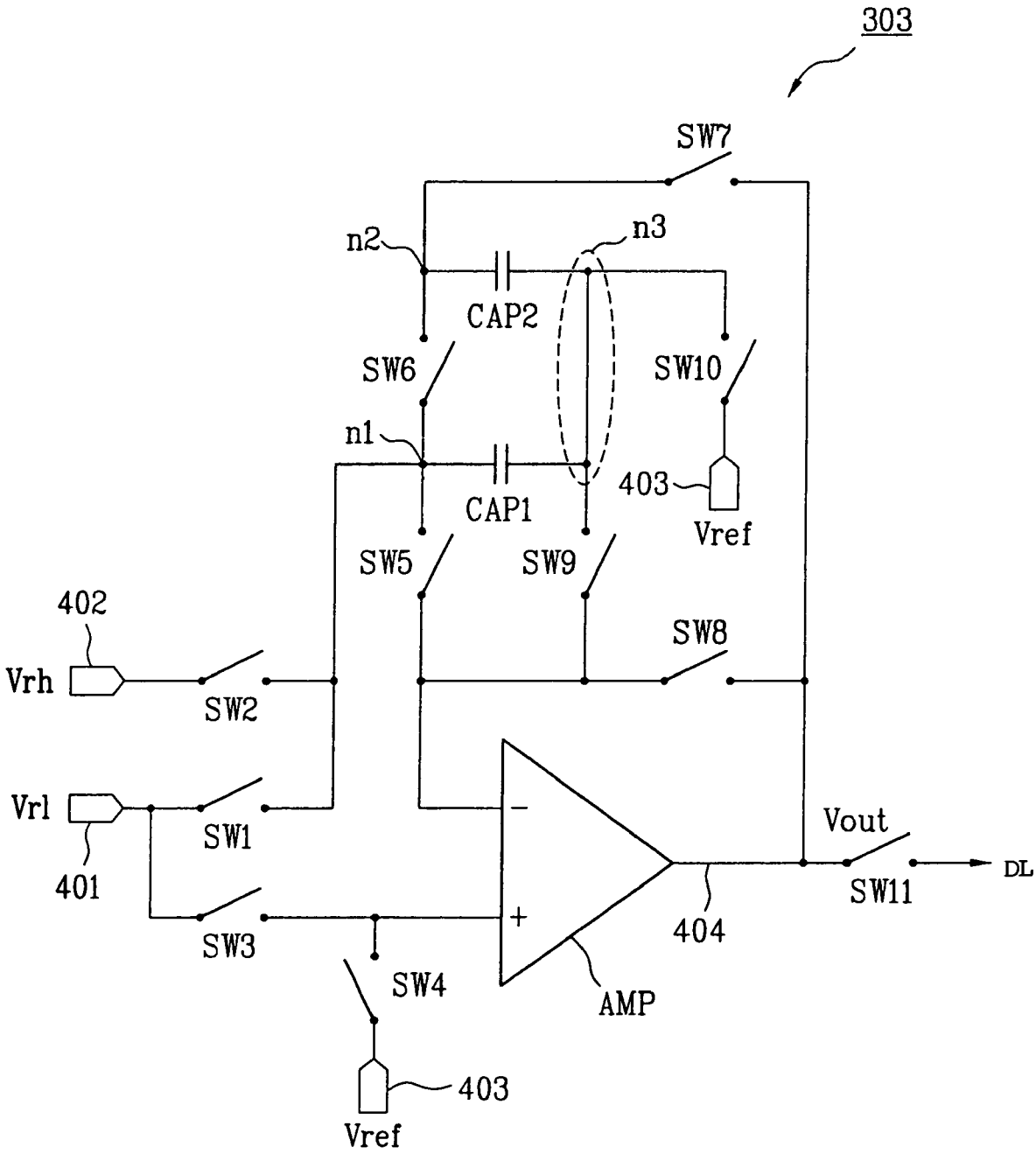
FIG. 3 illustrates a circuit of an intermediate gray level voltage generator of FIG. 2.

Here, the intermediate gray level voltage generator 303 will be described in detail as follows. FIG. 3 illustrates a circuit of an intermediate gray level voltage generator of FIG. 2. As shown in the FIG. 3, the intermediate gray level voltage generator 303 includes an amplifier AMP, first and second capacitors CAP1 and CAP2, and $1^{st}$-$11^{th}$ switches SW1-SW11.

The $1^{st}$ switch SW1 is connected between a first input lead 401 to which the first gray level voltage Vrl is inputted and a first node nil. The $2^{nd}$ switch SW2 is connected between a second input lead 402 to which the second gray level voltage Vrh is inputted and the first node n1. The $3^{rd}$ switch SW3 is connected between the first input lead 401 and a non-inverting lead (+) of the operational amplifier AMP. The $4^{th}$ switch SW4 is connected between a third input lead 403 to which a reference voltage Vref is inputted and the non-inverting lead (+) of the operational amplifier AMP. The $5^{th}$ switch SW5 is connected between the first node nil and the inverting lead (−) of the operational amplifier AMP. The $6^{th}$ switch SW6 is connected between the first node n1 and a second node n2. The $7^{th}$ switch SW7 is connected between the second node n2 and an output lead 404 of the operational amplifier AMP. The $8^{th}$ switch SW8 is connected between the output lead 404 and an inverting lead (−) of the operational amplifier AMP. The $9^{th}$ switch SW9 is connected between the inverting lead (−) and a third node n3 of the operational amplifier AMP. The $10^{th}$ switch SW10 is connected between the third node n3 and the third input lead 403. The $11^{th}$ switch SW11 is connected between the output lead 404 of the operational amplifier AMP and a data line DL of an LCD panel.

In addition, the first capacitor CAP1 is connected between the first node n1 and the third node n3. The second capacitor CAP2 is connected between the second node n2 and the third node n3.

The following description illustrates the operations of the circuit for driving an LCD device in accordance with the illustrated embodiment.

The gray level voltage generator 301 divides a plurality of reference gray level voltages Vgma, which are provided from the outside, into a plurality of gray level voltages through the resistors, and then provides the gray level voltages to the decoder unit 302. The decoder unit 302 selects a first gray level voltage Vrl among the gray level voltages corresponding to 5 most significant bits of the inputted 6-bit data. Also, the decoder unit 302 selects a second gray level voltage Vrh whose value is higher (or lower) than the first gray level voltage Vrl by one gray level of the total 32 gray levels. The decoder then provides the selected first and second gray level voltages Vrl and Vrh to the intermediate gray level voltage generator 303. More specifically, the decoder unit 302 provides the first and second gray level voltages Vrl and Vrh to the first and second input leads 401 and 402 of the intermediate gray level voltage generator 303, respectively.

The intermediate gray level voltage generator 303 uses the first gray level voltage Vrl with the second gray level voltage Vrh to generate a third gray level voltage whose gray level is between the first gray level voltage Vrl and the second gray level voltage Vrh. After that, the intermediate gray level voltage generator 303 reads out a logic value of the least significant bit of the 6-bit data, and then selectively outputs the first gray level voltage Vrl or the third gray level voltage based on the readout result.

More specifically, the intermediate gray level voltage generator 303 will be described as follows, referring to FIGS. 4A-4D. FIGS. 4A-4D illustrate circuits for describing operations of the intermediate gray level voltage generator according to the present invention. The following description illustrates the operations of the intermediate gray level voltage generator 303 when the logic value of the least significant bit is "0."

Figure 4A:
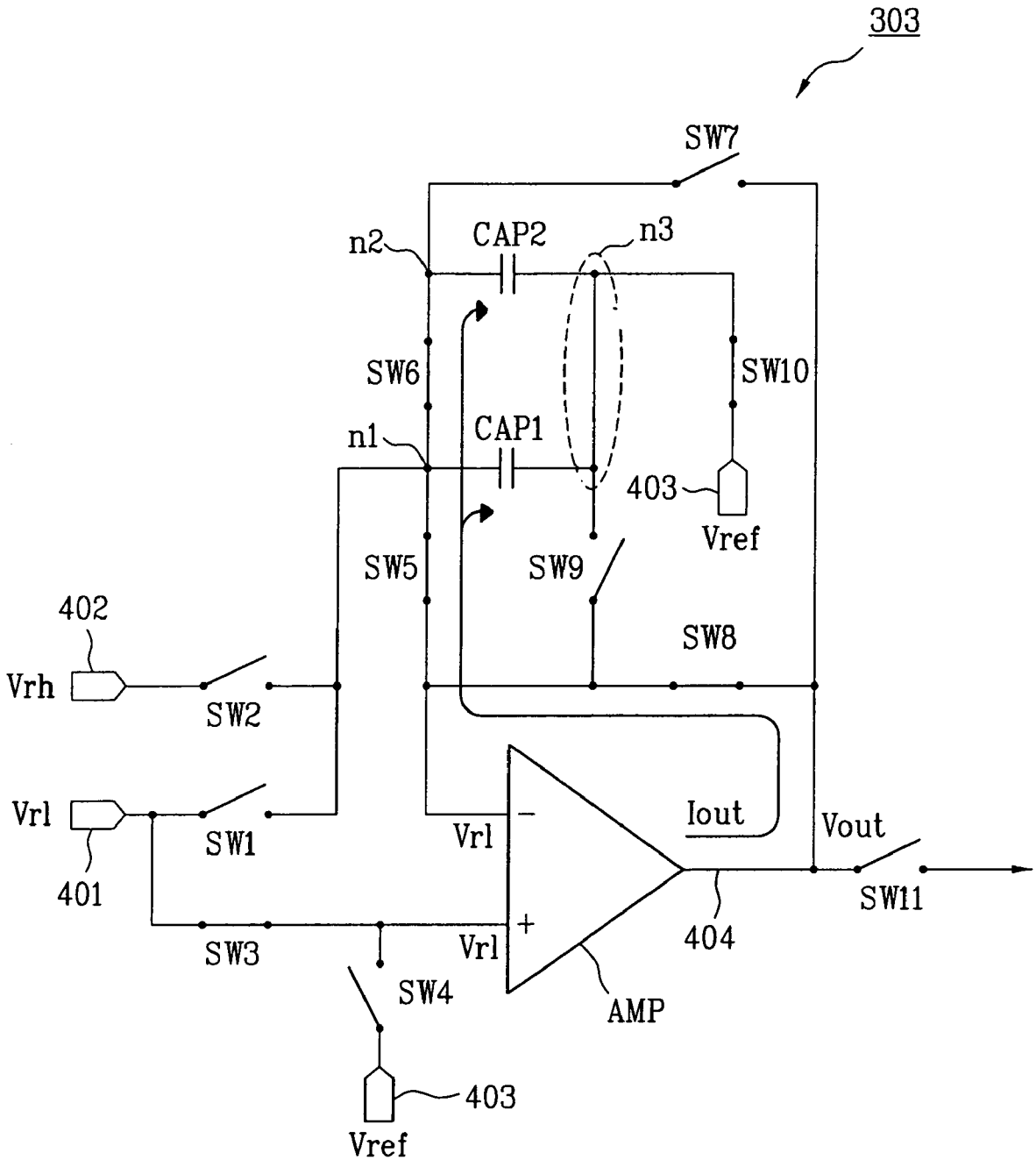
FIG. 4A-4D illustrate circuits for describing operations of the intermediate gray level voltage generator according to an embodiment of the present invention.

First Period:

For the first period, as shown in FIG. 4A, the $3^{rd}$, $5^{th}$, $6^{th}$, $8^{th}$ and $10^{th}$ switches (SW3, SW5, SW6, SW8, and SW10) are closed, and the remaining switches (SW1, SW2, SW4, SW7, SW9, SW11) are opened. Namely, the $3^{rd}$, $5^{th}$, $6^{th}$, $8^{th}$ and $10^{th}$ switches (SW3, SW5, SW6, SW8, and SW10) are turned on, and the remaining switches (SW1, SW2, SW4, SW7, SW9, SW1) are tuned off.

In the first period, the first gray level voltage Vrl, which is inputted to the first input lead 401, is inputted to the non-inverting lead (+) of the amplifier AMP through the $3^{rd}$ switch SW3. Here, the inverting lead (−) of the amplifier AMP becomes the same voltage as the inverting lead (+) due to the feedback mechanism of the operational amplifier AMP. Namely, the inverting lead (−) also inputs the first gray level voltage Vrl. Also, since the feedback path of the operational amplifier AMP, i.e., between the output lead 404 and the inverting lead (−), is shorted by the $8^{th}$ switch SW8, the output lead 404 outputs the first gray level voltage Vrl to its inverting lead (−). Here, the operational amplifier AMP generates a current Iout according to the first gray level voltage Vrl inputted to the non-inverting lead (+) thereof, and then outputs the current Iout through the output lead 404 thereof.

On the other hand, when the operation amplifier AMP is an ideal operational amplifier, its output impedance is zero such that the current Iout generated at the output lead 404 of the amplifier AMP is ideally infinite. However, since the output lead 404 actually has a resistance component, the output current is somewhat reduced. However, the resistance component is very little in magnitude compared with that of the output current Iout. Therefore, although the resistance component is considered, the current Iout flowing through the output lead 404 is relatively large. The current Iout outputted from the output lead 404 is divided and inputted to the inverting lead (−) and the capacitors CAP1 and CAP2. Since input impedance of an ideal operational amplifier is indefinite, the inverting lead (−) of the operational amplifier AMP cannot receive the current Iout. Therefore, the current Iout is divided and inputted to the first and second capacitors CAP1 and CAP2 such that the capacitors CAP1 and CAP2 can be charged.

As described above, since the current Iout outputted from the operational amplifier AMP is almost infinite, the first and second capacitors CAP1 and CAP2 are charged at a relatively high speed.

The first period is a pre-charge period where the first and second capacitors CAP1 and CAP2 are pre-charged. Namely, the first and second capacitors are rapidly charged by a relatively large current Iout which is generated according to the high current drive capability of the operation amplifier AMP. Therefore, unlike the related art, the gray level voltage generator 301 does not need to generate a relatively large current. Accordingly, the power consumption of the gray level voltage generator 301 can be reduced, compared with the related art device.

Figure 4B:
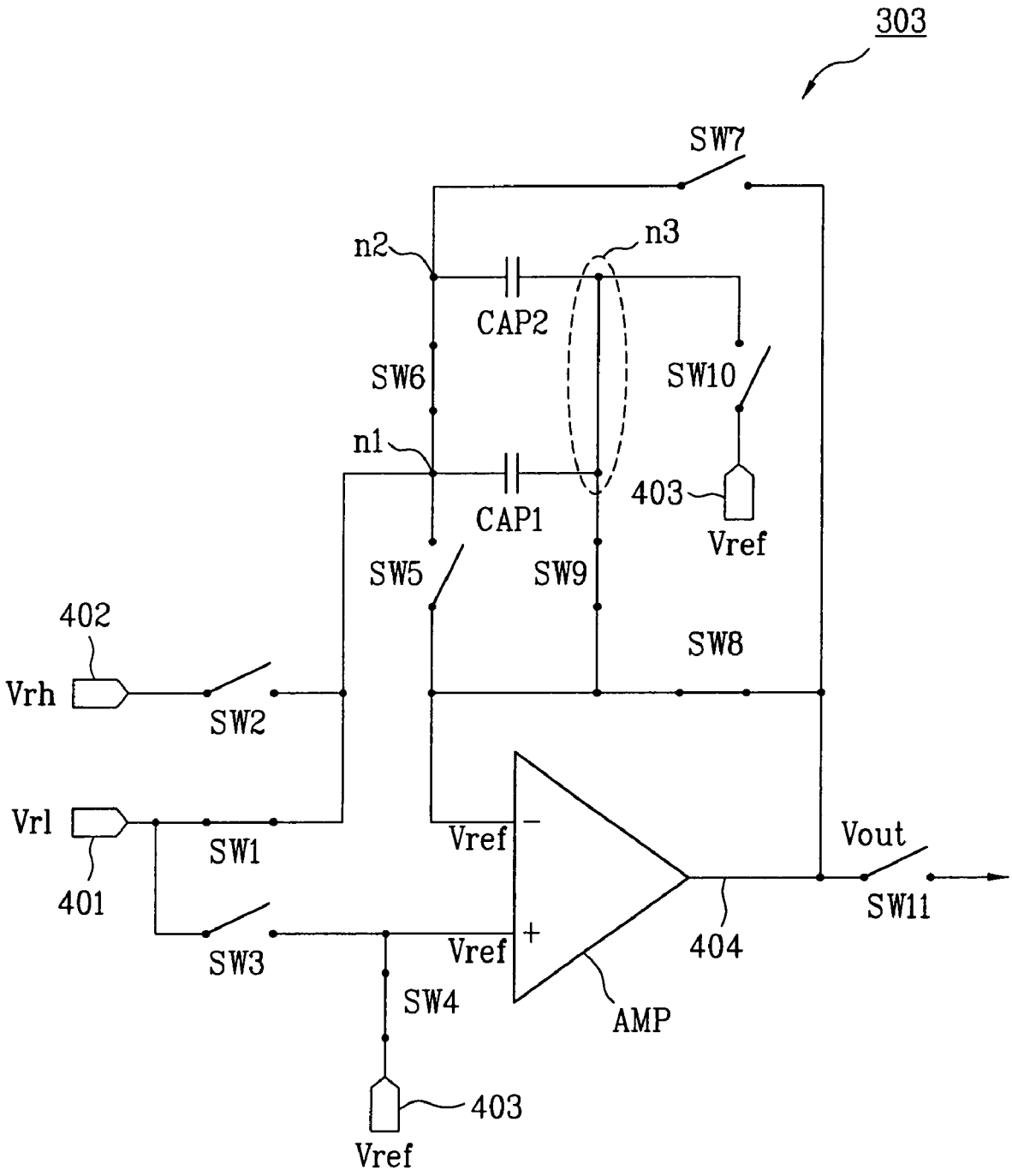

Second Period:

As shown in FIG. 4B, the $1^{st}$, $4^{th}$, $6^{th}$, $8^{th}$ and $9^{th}$ switches (SW1, SW4, SW6, SW8, and SW9) are closed, and the remaining switches (SW2, SW3, SW5, SW7, SW10, SW11) are opened. Namely, the $1^{st}$, $4^{th}$, $6^{th}$, $8^{th}$ and $9^{th}$ switches (SW1, SW4, SW6, SW8, and SW9) are turned on, and the remaining switches (SW2, SW3, SW5, SW7, SW10, SW11) are tuned off.

In the second period, the first gray level voltage Vrl, which is inputted to the input lead 401, is inputted to one end of the first capacitor CAP1 (i.e., the first node n1). Also, the first gray level voltage Vrl is inputted to one end of the second capacitor CAP2 (i.e., the second node n2) through the $1^{st}$ switch SW1 and the $6^{th}$ switch SW6.

On the other hand, since the reference voltage Vref is provided to the non-inverting lead (+) of the operational amplifier AMP through the $4^{th}$ switch SW4 for the second period, the inverting lead (−) also inputs the reference voltage Vref by the feedback mechanism of the operational amplifier AMP. Also, since the feedback path of the operational amplifier AMP, i.e., between the output lead 404 and the inverting lead (−), is shorted by the $8^{th}$ switch SW8, the output lead 404 outputs the reference voltage Vref. The reference voltage Vref, which is applied to the inverting lead (−) and the output lead 404, is provided to the other ends of the first and second capacitors CAP1 and CAP2 (i.e., the third node n3), respectively, through the $9^{th}$ switch SW9. Therefore, the respective first and second capacitors CAP1 and CAP2 are charged with a voltage corresponding to a difference between the reference voltage Vref and the first gray level voltage Vrl. Here, since the polarities of the first and second capacitors CAP1 and CAP2 are opposite to each other, the polarity of the voltage (Vref−Vrl+a) charged in the first capacitor CAP1 is opposite to that of the voltage (Vrl−Vref−a) charge in the second capacitor CAP2. Here, the symbol 'a' denotes an offset canceling voltage indicating a voltage difference between the inverting lead (−) and the non-inverting lead (+) of the operational amplifier AMP. The offset canceling voltage is zero in the ideal operational amplifier. The detailed description for the offset canceling voltage will be omitted in this application.

Figure 4C:
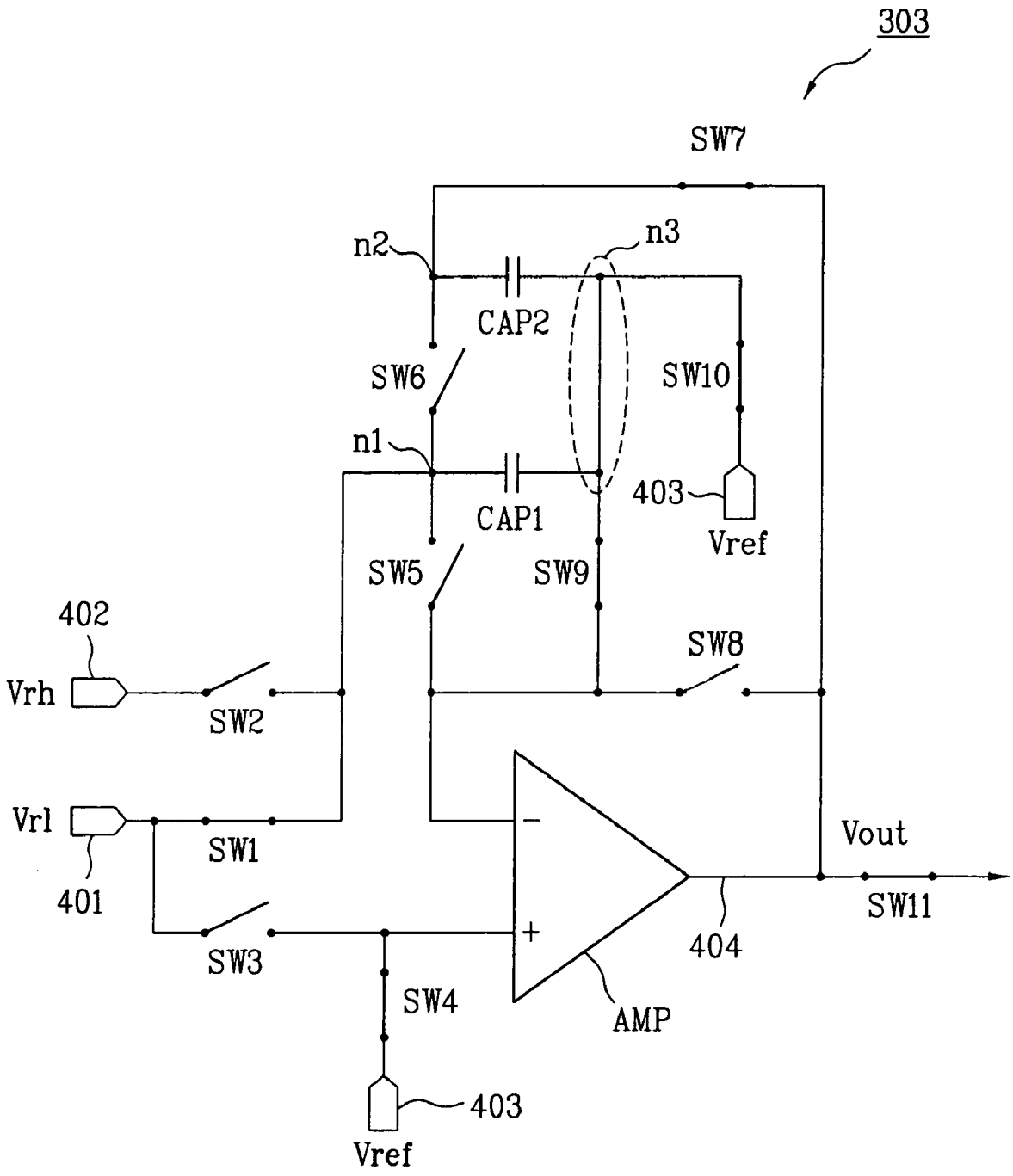

Third Period:

As shown in FIG. 4C, the $1^{st}$, $4^{th}$, $7^{th}$, $9^{th}$, $10^{th}$, and $11^{th}$ switches (SW1, SW4, SW7, SW9, SW10, and SW11) are closed, and the remaining switches (SW2, SW3, SW5, SW6 and SW8) are opened. Namely, the $1^{st}$, $4^{th}$, $7^{th}$, $9^{th}$, $10^{th}$, and $11^{th}$ switches (SW1, SW4, SW7, SW9, SW10, and SW11) are turned on, and the remaining switches (SW2, SW3, SW5, SW6 and SW8) are tuned off.

In the third period, since the first gray level voltage Vrl and the reference voltage Vref are provided to both ends of the first capacitors CAP1, the voltage (Vref−Vrl) stored in the first capacitor CAP1 is the same voltage as in the second period. On the other hand, as the $6^{th}$ switch SW6 is turned off and the $7^{th}$ switch SW7 is turned on, a voltage other than the reference voltage is provided to the one end of the second capacitor CAP2. Namely, as the $6^{th}$ switch SW6 is turned off and the $7^{th}$ switch SW7 is turned on, since the second capacitor CAP2 used as a load is connected to the feedback path between the output lead 404 and the inverting lead (−), the output lead 404 of the operational amplifier AMP is applied by the following output voltage Vout. The output voltage Vout applied to the output lead 404 is applied to the one end of the second capacitor CAP2.

The following description illustrates how the output voltage Vout is obtained. Firstly, as the $6^{th}$ switch SW6 is turned off and the $7^{th}$ switch SW7 is turned on for the third period, the output voltage Vout is applied to the one end of the second capacitor CAP2. Also, the $10^{th}$ switch SW10 is turned on for the third period, the reference voltage Vref is provided to the other end of the second capacitor CAP2 through the $10^{th}$ switch SW10. Therefore, the second capacitor CAP2 stores a difference voltage (Vout−Vref) between the output voltage Vout and the reference voltage Vref for the third period.

On the other hand, the change of the amount of charges stored in the first capacitor CAP1 is identical to that of amount of charges stored in the second capacitor CAP2 from the second period to the third period. Namely, the change of the amount of charges is proportional to product of capacitance of a capacitor and variation of voltage, $Q=C\cdot\Delta V$. Therefore, the changes of amount of charges of the first and second capacitors CAP1 and CAP2 can be described by the following Equation (1).

$$Q1=C1\cdot\Delta Vc1;\ Q2=C2\Delta Vc2 \quad (1)$$

Where Q1 denotes the change of the amount of charges of the first capacitor CAP1, C1 denotes capacitance of the first capacitor CAP1, and Vc1 denotes a voltage difference between the voltage (Vref−Vrl) stored in the first capacitor CAP1 for the third period and the voltage (Vref−Vrl) stored in the first capacitor CAP1 for the second period.

Also, Q2 denotes the change of the amount of charges of the second capacitor CAP2, C2 denotes capacitance of the second capacitor CAP2, and Vc2 denotes a difference voltage between the voltage (Vout−Vref) stored in the second capacitor CAP2 for the third period and the voltage (Vrl−Vref) stored in the second capacitor CAP2 for the second period.

As described above, since the respective changes Q1 and Q2 of the amount of charges of the capacitors CAP1 and CAP2 are identical to each other, equation (1) can be expressed by following Equation (2).

$$C1\{Vref-Vrl-(Vref-Vrl)\}=-C2\{Vout-Vref-(Vrl-Vref)\} \quad (2)$$

When C2 is divided into both sides of Equation (2) and Equation (2) is rearranged with respect to the output voltage Vout, the output voltage Vout can be expressed by the following Equation (3).

$$Vout=Vrl \quad (3)$$

For the first to third periods, the logic value of the least significant bit of the 6 bits data, which is provided to the intermediate gray level voltage generator 303, is '0.' Here, the intermediate gray level voltage generator 303 outputs the first gray level voltage Vrl. Namely, as described in Equation (3), the output voltage Vout of the intermediate gray level voltage generator 303 is the first gray level voltage Vrl.

The following description illustrates the operations of the intermediate gray level voltage generator 303 when the logic value of the least significant bit is "1."

First and Second Periods:

Firstly, as shown in FIG. 4A and FIG. 4B, the intermediate gray level voltage generator 303 inputs the first and second gray level voltages Vrl and Vrh through the gray level voltage generator 301, for the first and second periods. The operations of the intermediate gray level voltage generator 303 are operated as described above same as when the logic value of the least significant bit is "0."

Figure 4D:
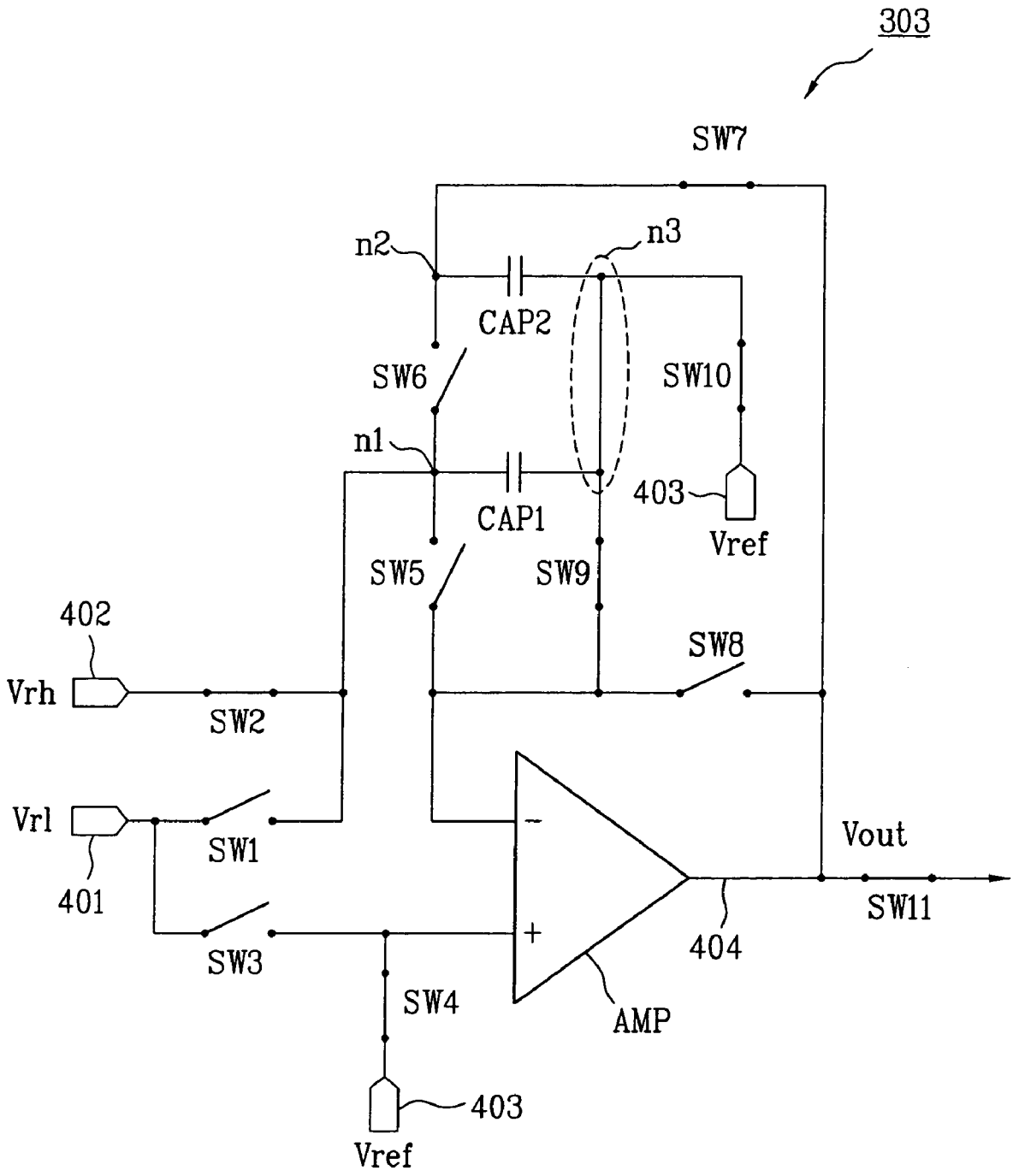

Third Period:

In the third period, as shown in FIG. 4D, the $2^{nd}$, $4^{th}$, $7^{th}$, $9^{th}$, $10^{th}$, and $11^{th}$ switches (SW2, SW4, SW7, SW9, SW10, and SW11) are closed, and the remaining switches (SW1, SW3, SW5, SW6, and SW8) are opened. Namely, the $2^{nd}$, $4^{th}$, $7^{th}$, $9^{th}$, $10^{th}$, and $11^{th}$ switches (SW2, SW4, SW7, SW9, SW10, and SW11) are turned on, and the remaining switches (SW1, SW3, SW5, SW6, and SW8) are tuned off.

In the third period, one end of the first capacitor CAP1 is connected to the second input lead 402 through the second switch SW2, and the other end of the first capacitor CAP1 is connected to the inverting lead (−) of the operational amplifier AMP through the $9^{th}$ switch SW9. The other end of the first capacitor CAP1 is connected to the third input lead 403 through the $10^{th}$ switch SW10.

One end of the second capacitor CAP2 is connected to the output lead 404 of the operational amplifier AMP through the $7^{th}$ switch SW7 and the other end to the inverting lead (−) of the operational amplifier AMP through the $9^{th}$ switch SW9. In addition, the other end of the second capacitor is connected to the third input lead 403 through the $10^{th}$ switch SW10.

Here, the second gray level voltage Vrh is provided to the second input lead 402, and the reference voltage Vref is provided to the third input lead 403. Therefore, the first capacitor CAP1 stores a voltage difference Vref−Vrh between the reference voltage Vref and the second gray level voltage Vrh for the third period. On the other hand, the second capacitor CAP2 stores a voltage difference Vout−Vref between the output voltage Vout and the reference voltage Vref.

As described above, the change of the amount of charges stored in the first capacitor CAP1 is identical to that of the amount of charges stored in the second capacitor CAP2. The relation between changes of amount of charges between the first and the second capacitors CAP1 and CAP2 is described as follows.

$$C1\{Vref-Vrh-(Vref-Vrl)\}=-C2\{Vout-Vref-(Vrl-Vref)\} \quad (4)$$

When C2 is divided into both sides of Equation (4) and Equation (4) is rearranged with respect to the output voltage Vout, the output voltage Vout can be expressed by the following Equation (5).

$$Vout=C1/C2(Vrh-Vrl)+Vrl \quad (5)$$

As described in Equation (5), the output voltage Vout is affected by capacitances C1 and C2 of the first and second capacitors CAP1 and CAP2, respectively. The output voltage Vout is the third gray level voltage which is between the first gray level voltage Vrl and the second gray level voltage Vrh.

Therefore, the intermediate gray level voltage generator 303 outputs the first gray level voltage Vrl or the third gray level voltage according to the logic value of the least significant bit of the inputted 6-bit data.

As described above, the illustrated circuit for driving an LCD device can rapidly charge the capacitors using the relatively high current driving capability of an operational amplifier, such that the circuit can reduce its power consumption.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A circuit for driving a liquid crystal display device, comprising:

a gray level voltage generator for generating a plurality of gray level voltages; and an intermediate gray level voltage generator for receiving a first gray level voltage and a second gray level voltage among the plurality of gray level voltages and for selectively outputting one of the first gray level voltage and a third gray level voltage through a plurality of capacitors, a value of the third gray level voltage being between the first and second gray level voltage and set by the plurality of capacitors, the intermediate gray level voltage generator including:

an operational amplifier for pre-charging the plurality of capacitors using a current outputted from the operational amplifier and for selectively outputting one of the first gray level voltage and the third gray level voltage, and a switching device for selectively switching connections among the gray level voltage generator, the plurality of capacitors and the operational amplifier, such that the operational amplifier selectively outputs one of the first gray level voltage and the third gray level voltage, wherein the switching device comprises:

a 1st switch which is connected between a first input lead to which the first gray level voltage is inputted and a first node;

a 2nd switch which is connected between a second input lead to which the second gray level voltage is inputted and the first node;

a 3rd switch which is connected between the first input lead and an non-inverting lead of the operational amplifier;

a 4th switch which is connected between a third input lead to which a reference voltage is inputted and the non-inverting lead of the operational amplifier;

a 5th switch which is connected between the first node and the inverting lead of the operational amplifier;

a 6th switch which is connected between the first node and a second node;

a 7th switch which is connected between the second node and an output lead of the operational amplifier;

an 8th switch which is connected between the output lead and an inverting lead of the operational amplifier;

a 9th switch which is connected between the inverting lead and a third node;

a 10th switch which is connected between the third node and the third input lead; and an 11th switch which is connected between the output lead of the operational amplifier and a data line of the liquid crystal display device;

wherein the plurality of capacitors are a first capacitor and a second capacitor, the first capacitor being connected between the first node and the third node, the second capacitor being connected between the second node and the third node.

2. The circuit of claim 1, wherein an image data for the liquid crystal display device is an N-bit image data having K most significant bits, the plurality of gray level voltages correspond to $2^K$ gray levels, and K is smaller than N.

3. The circuit of claim 2, wherein the first gray level voltage is lower than the second gray level voltage by one of the $2^K$ gray levels.

4. The circuit of claim 2, wherein the first gray level voltage and the second gray level voltage are selected from the plurality of gray level voltages based on the K most significant bits of the N-bit image data.

5. The circuit of claim 2, wherein the intermediate gray level voltage generator selectively outputs one of the first gray level voltage and the third gray level voltage based on a least significant bit of the N-bit image data, and the least significant bit and the K most significant bits constituting the N-bit image data.

6. The circuit of claim 1, wherein the operational amplifier pre-charges the plurality of capacitors when the switching device is switched to provide a connection among the gray level voltage generator, the plurality of capacitors and the operational amplifier, such that an output terminal of the operational amplifier is directly connected to the plurality of capacitors and the current outputted from the output terminal of the operational amplifier directly supplies to the plurality of capacitors.

7. The circuit of claim 1, wherein when the operational amplifier selectively outputs one of the first gray level voltage and the third gray level voltage, the plurality of capacitors are connected in series by the switching device.

8. The circuit of claim 1, wherein the $3^{rd}$, $5^{th}$, $6^{th}$, $8^{th}$ and $10^{th}$ switches are closed for a first period, and the remaining switches are opened, the operational amplifier pre-charging the plurality of capacitors during the first period.

9. The circuit of claim 8, wherein the $1^{st}$, $4^{th}$, $6^{th}$, $8^{th}$ and $9^{th}$ switches are closed for a second period, and the remaining switches are opened.

10. The circuit of claim 9, wherein the $1^{st}$, $4^{th}$, $7^{th}$, $9^{th}$, $10^{th}$ and $11^{th}$ switches are closed for a third period, and the remaining switches are opened, the operational amplifier output the first gray level voltage during the third period.

11. The circuit of claim 9, wherein the $2^{nd}$, $4^{th}$, $7^{th}$, $9^{th}$, $10^{th}$ and $11^{th}$ switches are closed for the third period, and the remaining switches are opened, the operational amplifier output the third gray level voltage during the third period.

12. A method for driving a liquid crystal display device for displaying an image, comprising:

generating a plurality of gray level voltages;

selecting a first gray level voltage and a second gray level voltage from the plurality of gray level voltages by a switching device;

pre-charging a plurality of capacitors using a current outputted from an operational amplifier by the switching device; and selectively outputting one of the first gray level voltage and a third gray level voltage by the switching device, the plurality of capacitors and the operational amplifier, a value of the third gray level voltage being between the first and second gray level voltage and set by the plurality of capacitors, wherein the switching device comprises:

a 1st switch which is connected between a first input lead to which the first gray level voltage is inputted and a first node;

a 2nd switch which is connected between a second input lead to which the second gray level voltage is inputted and the first node;

a 3rd switch which is connected between the first input lead and an non-inverting lead of the operational amplifier;

a 4th switch which is connected between a third input lead to which a reference voltage is inputted and the non-inverting lead of the operational amplifier;

a 5th switch which is connected between the first node and the inverting lead of the operational amplifier;

a 6th switch which is connected between the first node and a second node;

a 7th switch which is connected between the second node and an output lead of the operational amplifier;

an 8th switch which is connected between the output lead and an inverting lead of the operational amplifier;

a 9th switch which is connected between the inverting lead and a third node;

a 10th switch which is connected between the third node and the third input lead; and an 11th switch which is connected between the output lead of the operational amplifier and a data line of the liquid crystal display device;

wherein the plurality of capacitors are a first capacitor and a second capacitor, the first capacitor being connected between the first node and the third node, the second capacitor being connected between the second node and the third node.

13. The method of claim 12, wherein the image data is an N-bit image data having K most significant bits, the plurality of gray level voltages correspond to $2^K$ gray levels, and K is smaller than N.

14. The method of claim 13, wherein the first gray level voltage is lower than the second gray level voltage by one of the $2^K$ gray levels.

15. The method of claim 13, wherein the first gray level voltage and the second gray level voltage are selected based on the K most significant bits of the N-bit image data.

16. The method of claim 13, wherein one of the first gray level voltage and the third gray level voltage is selected outputted based on a least significant bit of the N-bit image data, and the least significant bit and the K most significant bits constituting the N-bit image data.

17. The method of claim 12, wherein the pre-charging step includes providing a connection among the plurality of capacitors and the operational amplifier to directly connecting an output terminal of the operational amplifier to the plurality of capacitors such that the current outputted from the output terminal of the operational amplifier directly supplies to the plurality of capacitors.

18. The method of claim 17, wherein the step of providing the connection among the plurality of capacitors and the operational amplifier includes connecting the plurality of capacitors in parallel.

19. The method of claim 12, wherein the step of selectively outputs one of the first gray level voltage and the third gray level voltage includes connecting the plurality of capacitors in series.

20. The method of claim 12, further comprises a step of charging the capacitors between the steps of pre-charging the capacitors and outputting one of the first gray level voltage and the third gray level voltage.

* * * * *